US007078659B2

(12) United States Patent
Yokoyama et al.

(10) Patent No.: US 7,078,659 B2
(45) Date of Patent: Jul. 18, 2006

(54) CORROSION RESISTANCE STRUCTURE OF CERAMIC HEATER AND GAS SENSOR EQUIPPED WITH SAME

(75) Inventors: Taiji Yokoyama, Toyoake (JP); Kozo Takamura, Nagoya (JP); Makoto Shirai, Hekinan (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/110,819

(22) Filed: Apr. 21, 2005

(65) Prior Publication Data

US 2005/0236398 A1 Oct. 27, 2005

(30) Foreign Application Priority Data

Apr. 21, 2004 (JP) ..... 2004-125919
Dec. 21, 2004 (JP) ..... 2004-369998

(51) Int. Cl.
*H05B 3/50* (2006.01)

(52) U.S. Cl. ..... 219/544; 219/209; 219/270; 219/469; 219/523; 219/541; 219/553; 219/535; 204/424; 204/426; 204/428

(58) Field of Classification Search ..... 219/544, 219/209–210, 262, 270, 469, 523, 534–6, 219/541, 553, 89.22; 204/424–9
See application file for complete search history.

(56) References Cited

U.S. PATENT DOCUMENTS 4,512,871 A * 4/1985 Kato et al. ..... 204/429
6,118,110 A 9/2000 Kobayashi et al. ..... 219/548
6,121,590 A 9/2000 Kobayashi et al. ..... 219/553

FOREIGN PATENT DOCUMENTS

JP 11-292649 10/1999

* cited by examiner

*Primary Examiner*—Shawntina Fuqua
(74) *Attorney, Agent, or Firm*—Nixon & Vanderhyhe PC

(57) ABSTRACT

A ceramic heater is provided which may be employed in a gas sensor. The ceramic heater includes a heating element disposed inside a ceramic body, a connector assembly, and a cover coating. The connector assembly consists of an external terminal, a connector terminal, and a metallic joint layer. The external terminal is affixed to an outer surface of the ceramic body in electrical connection with the heating element. The joint layer is formed on the external terminal to establish an electrical joint between the external terminal and the connector terminal. The cover coating is wrapped over a surface of the connector assembly and made of a metallic material containing a main component of one of Au, Pt, and Cr, thereby ensuring a corrosion resistance of the connector assembly.

10 Claims, 10 Drawing Sheets

CORROSION RESISTANCE STRUCTURE OF CERAMIC HEATER AND GAS SENSOR EQUIPPED WITH SAME

CROSS REFERENCE TO RELATED DOCUMENT

The present application claims the benefit of Japanese Patent Application No. 2004-369998 filed on Dec. 21, 2004 and Japanese Patent Application No. 2004-125919 filed on Apr. 21, 2004, the disclosures of which are incorporated herein by reference.

BACKGROUND OF THE INVENTION

1. Technical Field of the Invention

The present invention relates generally to an improved structure of a ceramic heater designed to ensure the reliability of an electrical joint of an external connector to a body of the ceramic heater and a gas sensor quipped with such a ceramic heater.

2. Background Art

There are known gas sensors which are installed in an exhaust pipe of automotive engines to determine an air-fuel ratio of mixture for combustion control in the engine to enhance the efficiency of purifying exhaust emissions through a three-way catalytic converter installed in the exhaust pipe. Gas sensors of this type typically include a sensor element made of a solid electrolyte body possessing an oxygen ion conductivity. The sensor element usually has installed therein a ceramic heater which works to heat a body of the sensor element up to an activation temperature in order to measure the concentration of a gas correctly.

Japanese Patent First Publication No. 11-292649 (U.S. Pat. No. 6,121,590 and U.S. Pat. No. 6,118,110) assigned to the same assignee as that of this application discloses a typical ceramic heater for use in sensor elements of the type, as described above. FIG. 14 is a partially sectional view showing the ceramic heater.

The ceramic heater includes a ceramic body 91 and ceramic-metal connector assemblies 9 (only one is shown for the brevity of illustration). Each of the connector assemblies 9 consists of a metallic layer 92 affixed to the surface of the ceramic body 91, a connector terminal 94, and a joint layer 93 formed on the metallic layer 92 to make an electrical connection with the connector terminal 94. When the connector assemblies 9 are exposed to the gas for a long period of time, it may result in oxidization of the connector terminals 94, which causes the joint layers 93 to peel off the metallic layers 92, thus leading to disconnection of the connector terminals 94 from the ceramic body 91. In order to avoid this problem, the connector terminals 94 and the joint layers 93 are coated with electroless plated layers 95, respectively, which are each made of nickel or nickel-boron.

In recent years, the temperature of exhaust gas of automotive engines has been increased in order to meet legal requirements of emission control. This may result in erosion of the electroless plated layers 95 and oxidization of the connector terminals 94, thereby leading to disconnection of the connector terminals 94 from the ceramic body 91.

When a gas sensor equipped with the above type of ceramic is installed in an exhaust pipe of automotive engines, NOx contained in exhaust gasses may leak inside the gas sensor and react with moisture, which will be produced in a cold condition of the engine when at rest, to produce nitric acid. The nitric acid usually will be a cause of erosion of the Ni-plated layers 95, thus resulting in disconnection of the connector terminals 94 from the ceramic body 91.

SUMMARY OF THE INVENTION

It is therefore a principal object of the invention to avoid the disadvantages of the prior art.

It is another object of the invention to provide an improved structure of a ceramic heater designed to ensure the reliability of an electrical joint of an external connector to a body of the ceramic heater and a gas sensor quipped with such a ceramic heater.

According to one aspect of the invention, there is provided a ceramic heater which may be used in heating a sensor element of a gas sensor to a desired activation temperature. The ceramic heater comprises: (a) a ceramic body; (b) a heating element disposed inside the ceramic body; (c) a connector assembly; and a cover coating. The connector assembly includes an external terminal, a connector terminal, and a metallic joint layer. The external terminal is affixed to an outer surface of the ceramic body in electrical connection with the heating element. The connector terminal is connectable with an external power supply. The joint layer is formed on the external terminal to establish an electrical joint between the external terminal and the connector terminal. The cover coating is wrapped over a surface of the connector assembly and made of a metallic material containing a main component of one of Au, Pt, and Cr. This ensures the corrosion resistance of the connector assembly, thereby minimizing disconnection of the connecter terminal from the external terminal.

In the preferred mode of the invention, the main component of the metallic material may contain only one of Au and Pt. In this case, the cover coating preferably has a thickness of 2.5 μm to 10 μm.

The main component of the metallic material may alternatively contain only Cr. In this case, the cover coating preferably has a thickness of 0.1 μm to 15 μm.

The ceramic heater may further comprise a Ni-plated layer disposed on an inner surface of the cover coating. The Ni-plated layer preferably has a thickness of 2.0 μm to 24 μm.

According to the second aspect of the invention, there is provided a gas sensor which comprises a sensor element and a ceramic heater. The sensor element includes a solid electrolyte body, an air chamber formed inside the solid electrolyte body, an outer electrode affixed to an outer surface of the solid electrolyte body exposed to a gas to be measured, and an inner electrode affixed to an inner surface of the solid electrolyte body exposed to the air chamber. The ceramic heater is disposed within the air chamber and includes: (a) a ceramic body; (b) a heating element disposed inside the ceramic body; (c) a connector assembly, and (d) a cover coating. The connector assembly includes an external terminal, a connector terminal, and a metallic joint layer. The external terminal is affixed to an outer surface of the ceramic body in electrical connection with the heating element. The connector terminal is connectable with an external power supply. The joint layer is formed on the external terminal to establish an electrical joint between the external terminal and the connector terminal. The cover coating is wrapped over a surface of the connector assembly and made of a metallic material containing a main component of one of Au, Pt, and Cr.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OF THE PREFERRED EMBODIMENTS

Figure 1:
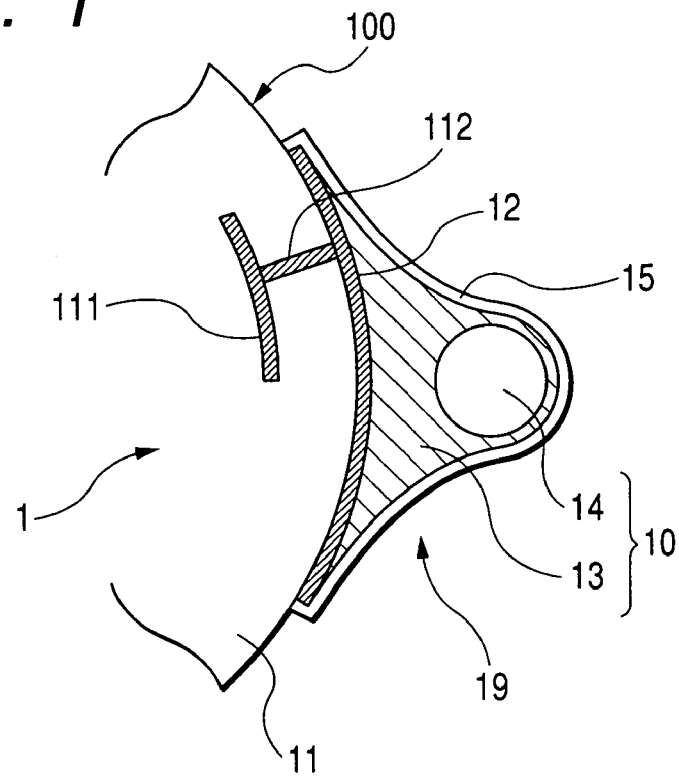
FIG. 1 is a partially traverse sectional view, as taken along the line A—A in FIG. 3, which shows a joint structure of a ceramic heater according to the first embodiment of the invention which establishes a joint between a connector terminal and an external terminal of a ceramic body and possesses an improved corrosion resistance.
Figure 2:
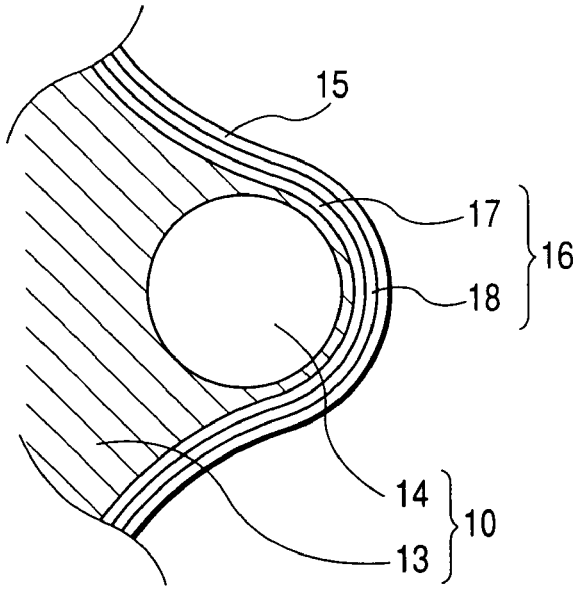
FIG. 2 is an enlarged sectional view of FIG. 1.
Figure 3:
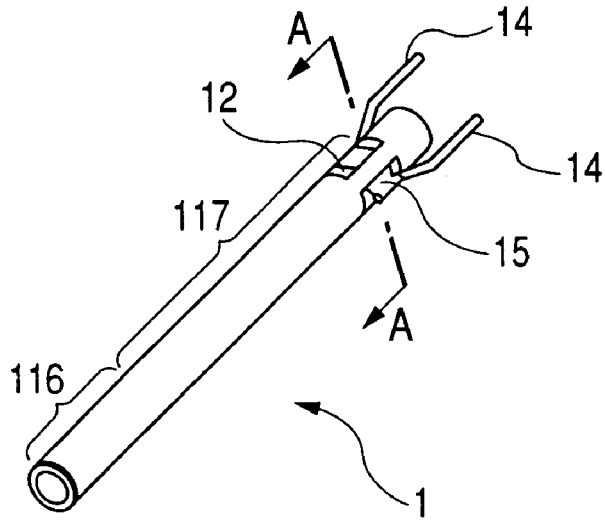
FIG. 3 is a perspective view which shows a ceramic heater of the first embodiment of the invention.

Referring to the drawings, wherein like reference numbers refer to like parts in several views, particularly to FIGS. 1, 2, and 3, there is shown a ceramic heater 1 according to the first embodiment of the invention which may be used in a gas sensor designed to measure the concentration of a given component of exhaust emissions of automotive engines.

The ceramic heater 1 is essentially made up of a bar-shaped ceramic body 11 and a heating element, as will be described later in detail, disposed inside the ceramic body 11. The ceramic heater 1 also includes connector assemblies 19 (only one is shown in FIG. 1 for the brevity of illustration). Each of the connector assemblies 19 consists of an external terminal 12 and an electrical connector 10. The external terminals 12 are affixed to an outer surface 100 of the ceramic body 11 in electrical connection with the heating element in the ceramic body 11. Each of the connectors 10 consists of a connector terminal 14 and a joint layer 13 which makes an electrical and mechanical joint between the connector terminal 14 and the external terminal 12. The joint layer 13 is wrapped in a cover coating 15 extending, as clearly illustrated in FIG. 1, so as to cover an entire outer surface of the connector assembly 19. The cover coating 15 is made of Au.

The ceramic heater 1, as can be seen from FIGS. 1 and 3, has a given length whose cross section is circular and which is made up of two parts: a heating section 116 and a supporting section 117. The heating section 116 has the heating element installed therein. The supporting section 117 supports the heating section 116 in alignment therewith and has disposed therein, as shown in FIG. 1, a lead 111 electrically connecting with the heating element.

Each of the external terminals 12 attached to the outer surface 100 of the ceramic body 11 is made of W (tungsten) and electrically connects with the lead 111 through a conductive hole 112. A content of W is preferably 70 wt % or more. The joint layer 13 contains 92% by weight of Cu and 8% by weight of Ni and makes an electrical joint between the external terminal 12 and the connector terminal 14. In use of the ceramic heater 1, the connector terminal 14 is to be connected to an external power supply (not shown) to supply electrical power to the heating element through the lead 111. The connector terminal 14 is made of a Ni-made lead wire having a diameter of 0.6 mm.

Between the cover coating 15 and the connector assembly 19, an Ni-plated coating 16, as clearly illustrated in FIG. 2, is formed. The Ni-plated coating 16 is made of a laminate of an Ni-electroless plated layer 17 affixed to the connector 10 and an Ni-electroplated layer 18 affixed to the cover coating 15.

The ceramic heater 1 is fabricated in the following manner.

Figure 4:
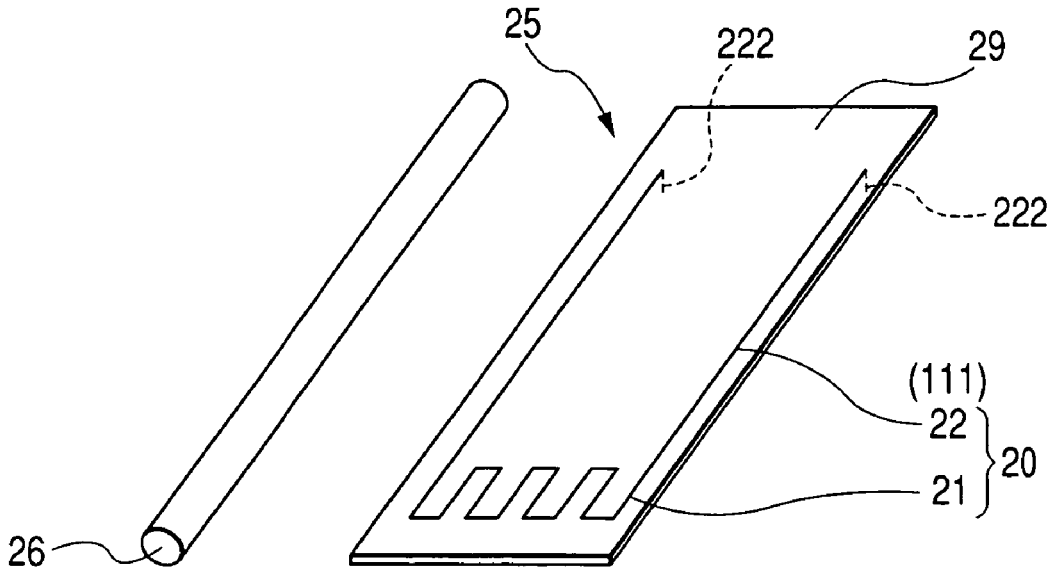
FIG. 4 is a perspective view which shows a production process of the ceramic heater, as illustrated in FIGS. 1, 2, and 3.

First, powders containing approximately 92 wt % of $Al_2O_3$ and a total of 8 wt % of $SiO_2$, CaO, and MgO are prepared. The powders are dispersed in a solvent to make slurry. The slurry is made into a 1.2 mm thick sheet using a doctor blade technique and stamped out by a stamp press to make a green sheet 25, as illustrated in FIG. 4. The green sheet 25 is drilled to make two pinholes 222 which will be the through holes 112.

Next, a heater pattern 20 is printed with a conductive paste by a screen printing technique on the green sheet 25. The heater pattern 20 consists of a heating section 21 which will be the above described heater element and lead sections 22 which will be the leads 111, as illustrated in FIG. 1. A conductive paste is filled in the pinholes 222.

Subsequently, on the back surface of the green sheet 25, terminals, which will be the external terminals 12, are printed with a conductive paste containing 100 wt % of W so that they connect electrically with the lead sections 222 through the pinholes 222.

An organic binder is prepared by melting ethylcellulose in an organic solvent. The organic binder is applied to the surface 29 of the green sheet 25 using the printing technique. The green sheet 25 is wrapped about the periphery of a core bar 26 and then fired in a furnace to make a ceramic bar.

To each of the external terminals 12 formed on the ceramic bar, the connector terminal 14 is joint with a brazing material containing 100 wt % of Cu at as high as 1000° C. to 1200° C. After such baking, the brazing material becomes the join layer 13 which establishes a firm joint between the external terminal 12 and the connector terminal 14.

Subsequently, the surface of the connector 10 is coated with Ni using an electroless plating technique to form the Ni-electroless plated layer 17 having a thickness of 4 μm or more. Further, the surface of the Ni-electroless plated layer 17 is coated with Ni with an electroplating technique to form the Ni-electroplated layer 18 having a thickness of 2 μm or more, thereby making the Ni-plated coating 16.

Finally, the surface of the Ni-plated coating 16 is electroplated with Au to form the cover coating 15 having a thickness of 2.5 μm, thereby completing the ceramic heater 1.

We perform a corrosion resistance test, as discussed below.

First, we prepared a sample E of the ceramic heater 1 and leave it in nitric acid vapor. We visually checked joining between the connector terminals 14 and the external terminals 12 and found that the connector terminals 14 were not separated at all after fifteen days. The corrosion resistance of the join layers 13 may alternatively be evaluated in a decreased time by heating the sample E and cooling it cyclically in the nitric acid vapor.

Each of the cover coatings 15 is, as described above, made of pure Au, but may alternatively be formed by plating the Ni-plated coatings 16 with pure Pt, pure Cr, Au alloy, Pt alloy, or Cr alloy. The Au, Pt, or Cr alloy may contains one or some of rhodium, palladium, and cobalt. We also found that the connector terminals 10 with each of those types of the coatings 15 are excellent in the corrosion resistance. Usually, Au and Pt are very insensitive to ionization as compared with metal such as Ni. Cu will be a non-conductor to oxide and thus is suitable for minimizing oxidization of the connector terminals 14 to avoid disconnection of the connector terminals 14 from the ceramic body 11. In a case of use of Au, each of the cover coatings 15 is preferably made of soft plated Au coating.

The thickness of each of the cover coatings 15 may be within a range of 2.5 μm to 10 μm. When the cover coating 15 is made of Au or Pt, and has a thickness of less than 2.5 μm, it may result in formation of small air holes therein which induce the corrosion. Alternatively, when the thickness is more than 10 μm, it has been found to hardly enhance the resistance of the cover coatings 15 to the corrosion and results in an increase in manufacturing cost of the ceramic heater 1.

When each of the cover coatings 15 is made of material containing a main component of Cr, the thickness thereof is preferably within a range of 0.1 μm to 15 μm. In a case of less than 0.1 μm, it may result in formation of small air holes in the cover coating 15 which induce the corrosion thereof. Alternatively, in a case of 15 μm, it may result in cracks in the cover coating 15 and an increased time required to form the cover coating 15.

The Ni-plated coating 16 formed inside each of the cover coating 15 serves to enhance the adhesion between the connector 10 and the cover coating 15 and may have a thickness (i.e., a total thickness of the Ni-electroless plated layer 17 and the Ni-electroplated layer 18) of 2.0 μm to 24 μm. In a case of less than 2.0 μm, it may result in formation of air holes in the surface of the coating 16 which compromise the adhesion to the cover coating 15. Alternatively, in a case of more than 10 μm, it results in an increased hardness of the coating 16, which gives rise to the breakage thereof caused by vibrations.

The Ni-plated coating 16 may alternatively be formed by a single Ni-plated layer which has a thickness of 2.0 μm to 24 μm.

Each of the joint layers 13 may be formed by a material containing a combination of Cu, Au, and Ni. For example, a material containing 40 wt % to 98 wt % of Cu, 2 wt % to 20 wt % of Ni, and 58 wt % or less of Au may be used which enhances the adhesion to the external electrode 12 to improve the lifetime of the ceramic heater 1.

When a Cu content is less than 40 wt %, the remaining components results in an increased hardness of the joint layer 13 which leads to cracks. Alternatively, when it is 98 wt % or more, in other words, when a total content of Ni and Au is small, it will result in lowered wettability of the joint layer 13 to the external terminal 12 made of W, etc., thus leading to a decrease in adhesion of the joint layer 14 to the external terminal 12.

When an Ni content is 2 wt % or less, it also results in lowered wettability of the joint layer 13 to the external terminal 12. Alternatively, when it is more than 20 wt %, and the external terminal 12 contains W, it will cause a large amount of W—Ni compound to be created during the formation of the joint layer 13 which leads to a decrease in strength of joint between the joint layer 13 and the external terminal 12.

When an Au content is more than 58%, it results in cracks in the joint layer 13 and also an increase in manufacturing cost of the ceramic heater 1.

Each of the joint layers 13 may contain 10 wt % or less of one or some of P, Cd, Pb, Zn, and Fe.

Each of the external terminals 12 preferably contains 70 wt % or more of W. This facilitates mixing with the ceramic body 11 containing alumina and enhances the heat resistance of the external terminals 12.

A content of Ni of each of the connector terminals 14 is preferably 25% or more, more preferably 90 wt % or more. This is because Ni contained in the connector terminal 14 is dispersed in the joint layer 13 when the connector terminal 14 is joined to the external terminal 12 by the joint layer 13, thereby enhancing the wettability of the joint layer 13 to the external terminal 12 to increase the strength of joint therebetween. For instance, the connector terminals 14 may be made of an alloy containing Ni such as Kovar or 42 alloy.

Each of the connector terminals 14 may is partially exposed outside the joint layer 13.

Figure 5:
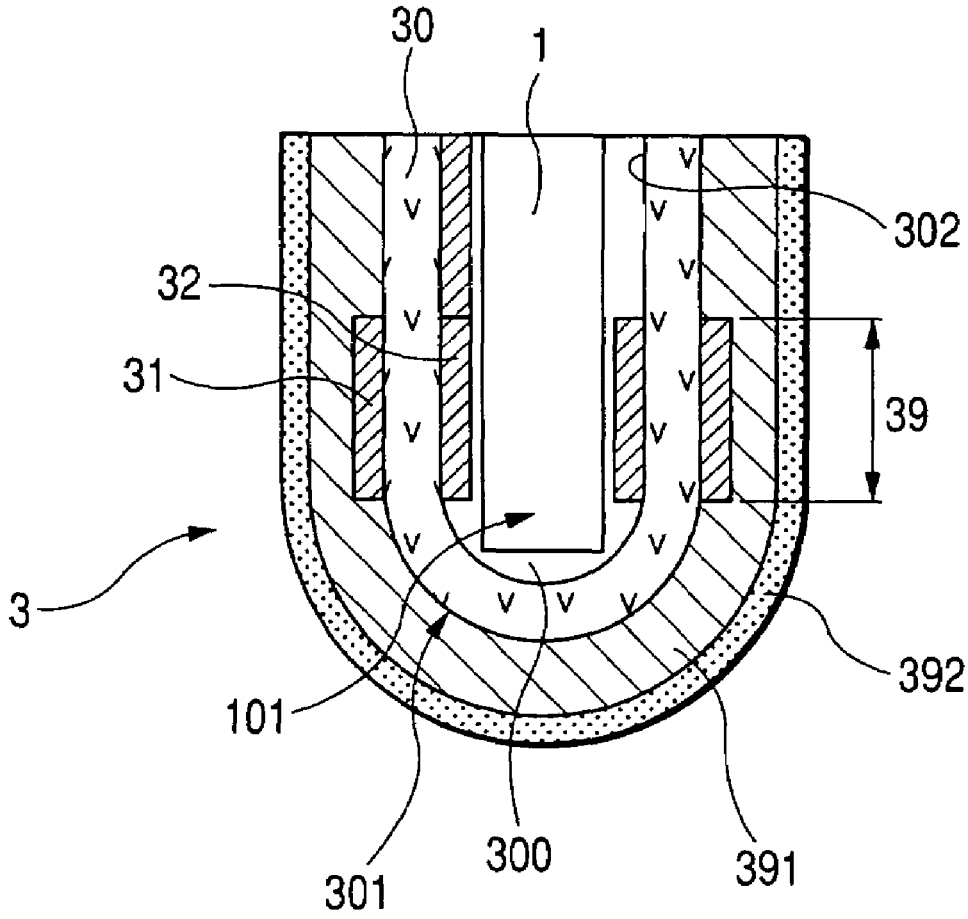
FIG. 5 is a longitudinal sectional view which shows a gas sensor element in which the ceramic heater, as illustrated in FIGS. 1, 2, and 3, is installed.

FIG. 5 is a partially longitudinal sectional view which shows a gas sensor element 3 having the ceramic heater 1 built therein.

The gas sensor element 3 includes a cup-shaped solid electrolyte body 30 and an air chamber 300 defined inside the solid electrolyte body 30. The solid electrolyte body 30 has an outer electrode 31 affixed to an outer side surface 301 and an inner electrode 32 affixed to an inner side surface 302. The outer electrode 31 is to be exposed to a gas to be measured. Te inner electrode 32 is to be exposed to air admitted to the air chamber 300. The ceramic heater 1 is retained within the air chamber 300.

A portion of the solid electrolyte body 30 through which the outer and inner electrodes 31 and 32 are opposed to each other works as a sensing area to measure, for example, the concentration of oxygen contained in the gas.

Protective layers 391 and 392 are wrapped over the outer electrode 31 and the solid electrolyte body 30.

The gas sensor element 3 may be installed in a gas sensor 4, as illustrated in FIG. 4.

The gas sensor 4 includes a hollow cylindrical housing 40, air covers 411, 412, and 413, and a protective cover assembly made up of an outer cover 421 and an inner cover 422. The air cover 411 is joined to a base end of the housing 40. The outer cover 421 is joined to a top end of the housing 40.

The inner cover 422 has defined therein a gas chamber 429 to which a gas to be measured is admitted. The gas sensor element 3 is retained inside the housing 40 with the outer electrode 31 exposed to the gas chamber 429.

Talc 401, a ring gasket 402, and an insulator 403 are fitted within an annular chamber defined between the outer wall of the gas sensor element 3 and the inner wall of the housing 40 to ensure securement of the gas sensor element 3 in the housing 40 and gas-tight sealing of the air chamber 300. The outer and inner covers 421 and 422 have formed therein gas inlets 420 through which the gas to be measured admitted into the gas chamber 429.

Figure 6:
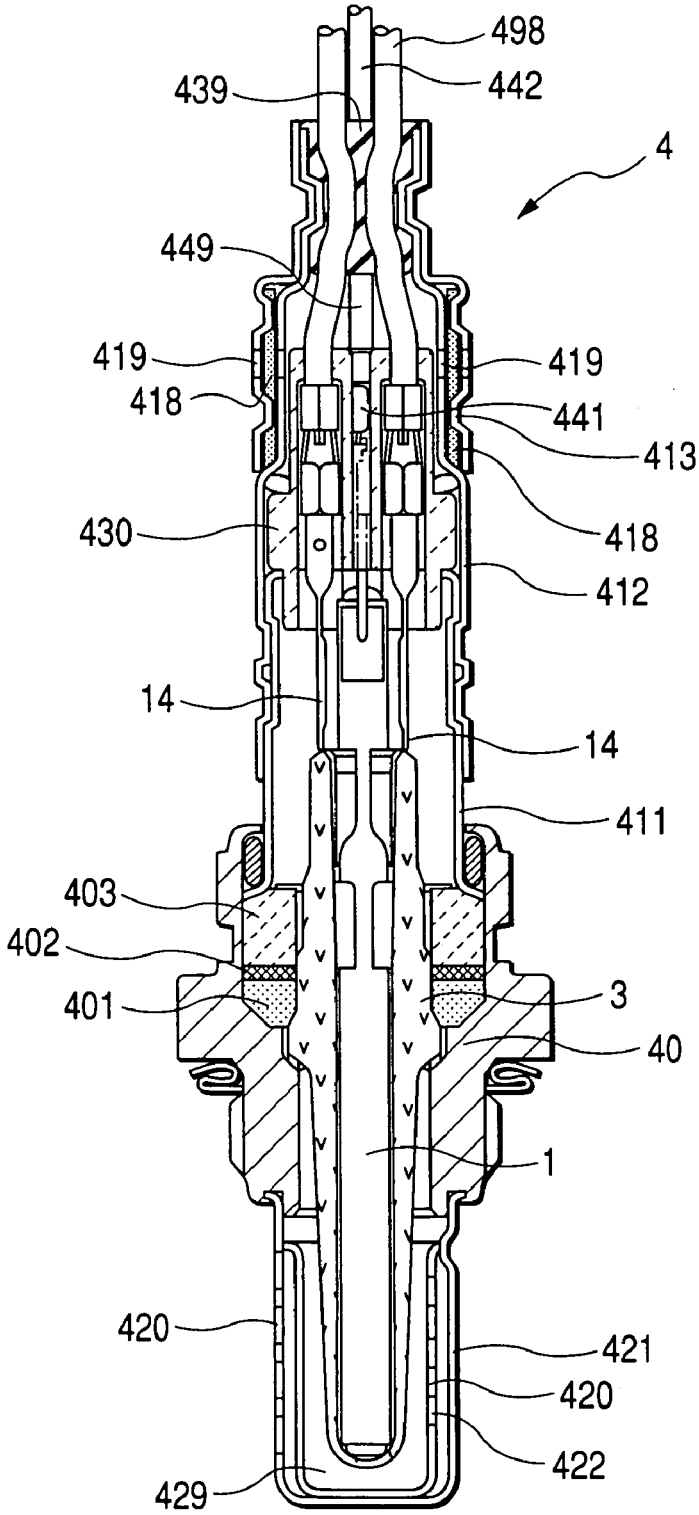
FIG. 6 is a longitudinal sectional view which shows a gas sensor equipped with the sensor element of FIG. 5.

An insulator 430 is fitted inside the air covers 411, 412, and 413 to retain conductors 442 therein which are joined at lower ends, as viewed in FIG. 6, to the connector terminals 14 of the ceramic heater 1 through connectors 441.

The conductors 442 extend outside the gas sensor 4 through a rubber bush 439 fitted in an open end of the air covers 412 and 413 for electrical connections with a power supply (not shown). Conductors 498 connect with the electrodes 31 and 32 of the gas sensor element 3 and also extend through the insulator 430 and the rubber bush 439 outside the gas sensor 4 for transmitting a sensor output to an external sensor controller (not shown).

A water-repellent filter 418 is retained between the air covers 412 and 413. The air covers 412 and 413 have formed therein air inlets 419 which communicate with each other through the water-repellent filter 418 and through which surrounding air is admitted into the air chamber 300 of the gas sensor element 3.

The gas sensor 4 is installed, for example, in an exhaust pipe of an automotive engine with the gas sensor element 3 subjected to intense heat of exhaust emission of the engine. We has confirmed that the connector terminals 14 of the ceramic heater 1 are not separated at all after the gas sensor element 3 is exposed to such a high pressure atmosphere for a long period of time.

The connector assemblies 19 of the ceramic heater 1 are, as described above, wrapped in the cover coatings 15 resistive to nitric acid corrosion. Usually, the exhaust gas of the automotive engine contains NOx which reacts with moisture to produce the nitric acid which may leak into the air chamber 300 of the gas sensor element 3 to which the ceramic heater 1 is exposed. Therefore, in the case where the gas sensor 4 is used in the exhaust pipe of the automotive engines, the connector assemblies 19 of the ceramic heater 1 work to resist corrosion caused by the nitric acid, thus avoiding disconnection of the connector terminals 14 from the external electrodes 12.

Figure 7:
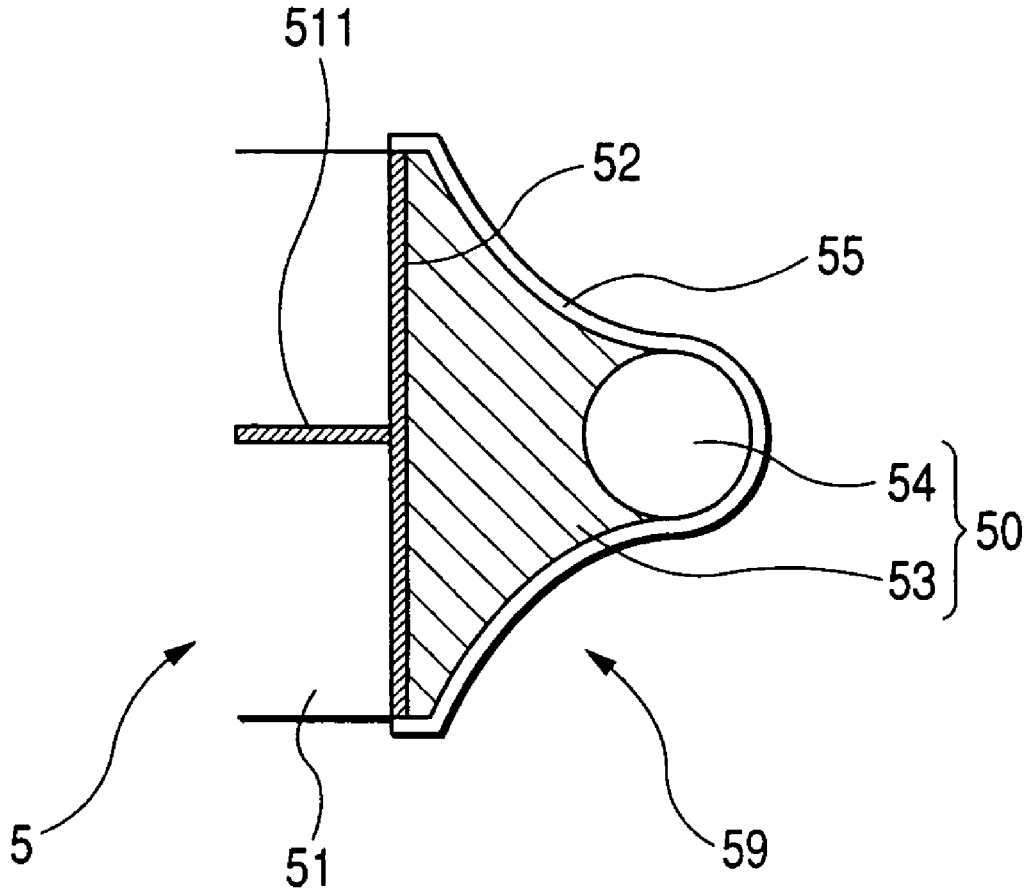
FIG. 7 is a partially traverse sectional view, as taken along the line B—B in FIG. 8(*d*), which shows a ceramic heater according to the second embodiment of the invention.
Figure 8A:
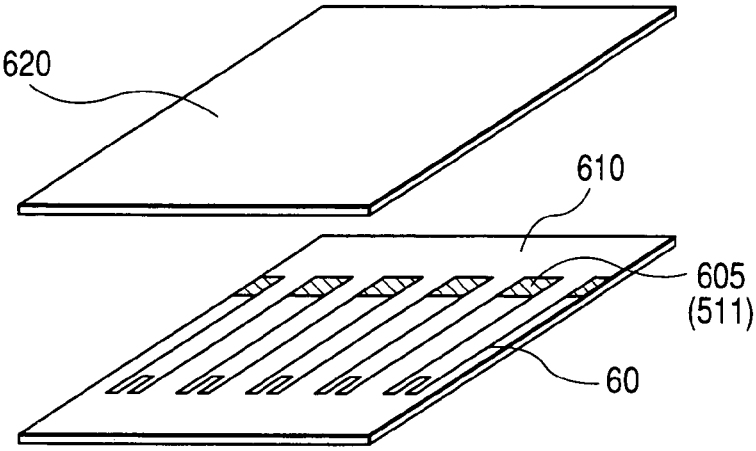
FIGS. 8(*a*), 8(*b*), 8(*c*), and 8(*d*) are perspective views which show a sequence of production processes of the ceramic heater of FIG. 7.
Figure 8B:
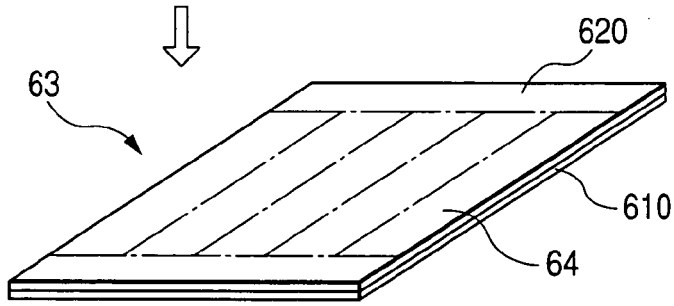
Figure 8C:
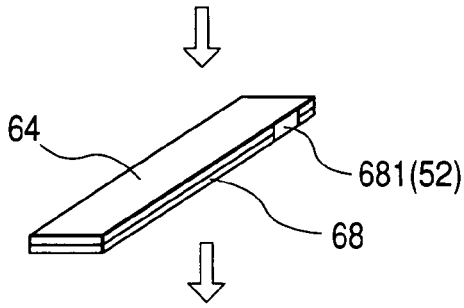
Figure 8D:
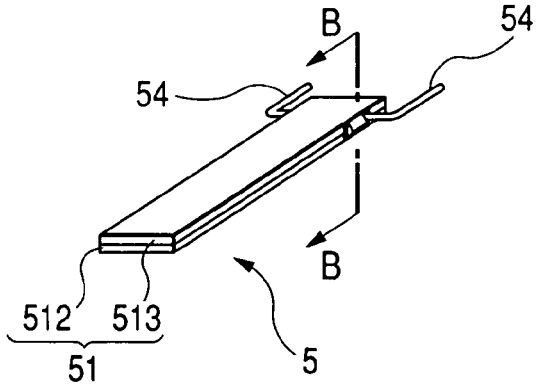

FIG. 7 is a partially sectional view which shows a ceramic heater 5 according to the second embodiment of the invention.

The ceramic heater 5 includes a ceramic body 51 having a heating element, as will be described later, in installed therein. The ceramic heater 5 also includes connector assemblies 59 each of which is made up of an external terminals 52 and an electrical connector 50. The external terminals 12 are affixed to outer side surfaces of the ceramic body 51 in electrical connection with the heating element in the ceramic body 51. Each of the connectors 50 consists of a connector terminal 54 and a joint layer 53 which makes an electrical and mechanical joint between the connector terminal 54 and the external terminal 52. An entire outer surface of each of the connector assemblies 59 is wrapped in a cover coating 55 made of Au.

The ceramic body 51, as can be seen from FIGS. 7 and 8(*d*), has a given length which is made up of a laminate of a heater substrate 512 and a cover plate 513. The heater substrate 512 has the heating element and leads 511 formed thereon. The cover plate 512 is laid on the surface of the heater substrate 512 to cover the heating element and the leads 511. The outer terminals 52 are affixed to the side surfaces of the ceramic body 51 in electrical connections with the connector terminals 54 through the joint layers 53. The connector terminals 54 are to be connected to an external power supply to supply electrical power to the heating element through the leads 511.

Each of the outer surface of the connector assemblies 59 is, like the above embodiments, covered with the cover coating 55 made of Au.

The others are identical with those in the first embodiment.

The ceramic heater 5 is fabricated in the following manner.

First, powders containing approximately 92 wt % of $Al_2O_3$ and a total of 8 wt % of $SiO_2$, CaO, and MgO are prepared. The powders are dispersed in a solvent to make slurry. The slurry is made into a 1.2 mm thick sheet using a doctor blade technique and stamped out by a stamp press to make, as illustrated in FIG. 8(*a*), 120 mm×120 mm green sheets 610 and 620. The green sheets 610 and 620 may alternatively be made by extrusion molding.

Next, a conductive paste containing a main component of metal such as W and an additive of Mo is prepared. Using the conductive paste, a plurality of heater patterns 60 are printed on the green sheet 610.

Between adjacent two of the heater patterns 60, lead patterns 605 are printed which will be the leads 511.

Subsequently, the green sheet 620 is bonded to the green sheet 610 to make a laminate 63, as illustrated in FIG. 8(*b*).

The laminate 63 may alternatively be made up of two or more green sheets 620 and two or more green sheets 610. The number of the green sheets 610 and 620 may be selected for any purpose of use of the ceramic heater 5. When a plurality of the green sheets 610 are used, the heater patterns 60 may be connected either in parallel or in series.

The laminate 63 is cut, as illustrated in FIG. 8(*b*), along broken lines, to a plurality of preforms 64 (only one is illustrated in FIG. 8(*c*)) each of which has one of the heater patterns 60 formed therein.

Subsequently, terminal patterns 681, which will be the external terminals 52, are printed with a conductive paste containing main component of W and an additive of Mo on side surfaces 68 of the perform 64 so that they connect electrically with the heater pattern 60 in the preform 64. The conductive paste may be the same as used in forming the heater patterns 60 or different therefrom.

The preform 64 is fired at 1400° C. to 1600° C. in a reduction atmosphere containing $N_2$ and $H_2$ gasses to make the ceramic body 51. The ends of the ceramic body 51 may be finished by a grinding machine to a desired shape.

To each of the external terminals 52 formed on the ceramic body 51, the connector terminal 54 is brazed with a brazing material containing 100 wt % of Cu at as high as 1000° C. to 1200° C. After the such baking, the brazing material becomes the join layer 53 which establishes a firm joint between the external terminal 52 and the connector terminal 54.

Finally, the surface of each of the connector assemblies 59 is coated with Au to form the cover coating 55 having a thickness of 2.5 μm, thereby completing the ceramic heater 5.

We have confirmed that the ceramic heater 5 is, like the one of the first embodiment, excellent in the corrosion resistance.

Figure 9:
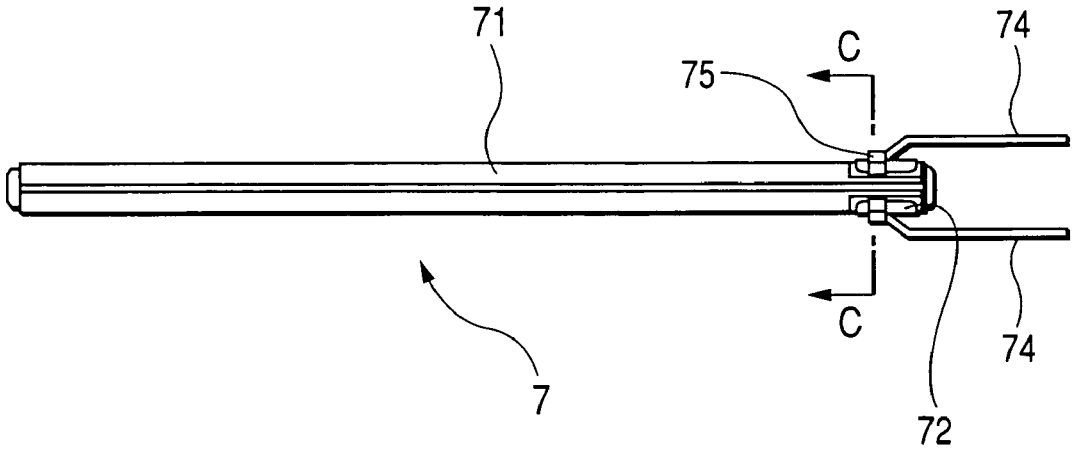
FIG. 9 is a side view which shows a ceramic heater according to the third embodiment of the invention.
Figure 10:
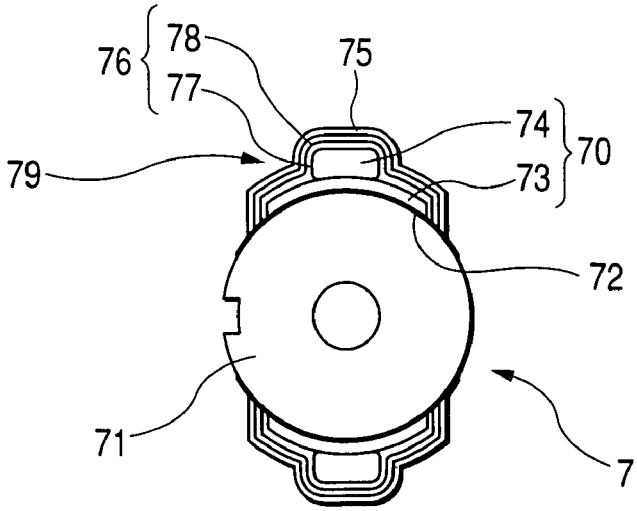
FIG. 10 is a partially traverse sectional view, as taken along the line C—C in FIG. 9, which shows the ceramic heater of FIG. 9.

FIGS. 9 and 10 shows a ceramic heater 7 according to the third embodiment of the invention.

The ceramic heater 7 includes a ceramic body 71 which has a heating element installed therein. The ceramic heater 7 also includes connector assemblies 79. Each of the connector assemblies 79 includes an external terminal 72 and an electrical connector 70. The external terminals 72 are affixed to an outer surface of the ceramic body 71 in electrical connection with the heating element in the ceramic body 71. Each of the connectors 70 consists of a connector terminal 74 and a joint layer 73 which makes an electrical and mechanical joint between the connector terminal 74 and the external terminal 72. An entire outer surface of the connector assemblies 79 is wrapped in the cover coating 75 made of Au.

The external terminals 72 are made of W (tungsten) and Ni (nickel). Each of the joint layers 73 is made of a Kovar pad and establishes an electrical connection with the connector terminal 74. The joint layers 73 may also contain Cu, Au, and/or Ni. The connector terminals 74 are to be connected to an external power supply to supply electrical power to the heating element in the ceramic body 71. The connector terminals 74 are made of a Ni-bar having a diameter of 0.6 mm.

Each of the connector assemblies 79 is, as described above, wrapped in the cover coating 75 made of Au.

Figure 11:
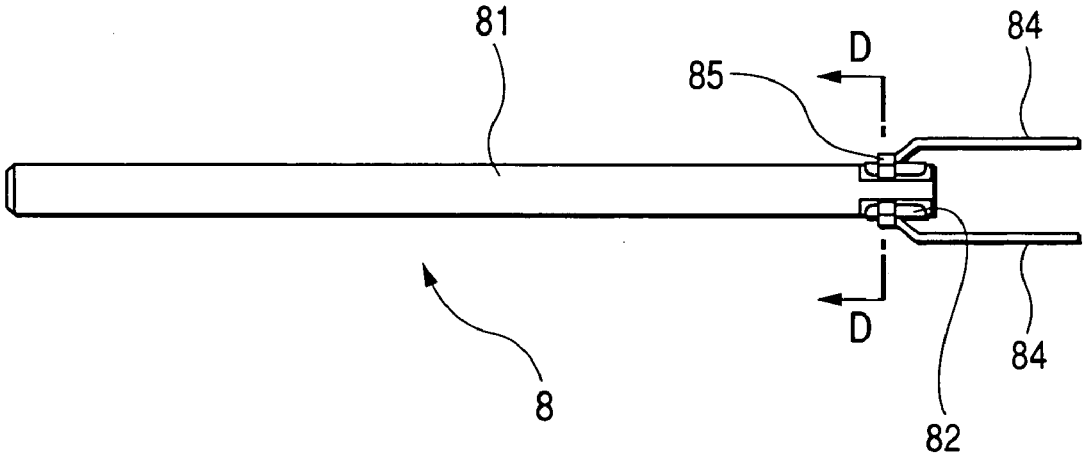
FIG. 11 is a side view which shows a ceramic heater according to the fourth embodiment of the invention.

Between each of the cover coatings 75 and a corresponding one of the connector assemblies 79, an Ni-plated coating 76, as clearly illustrated in FIG. 11, is formed. The Ni-plated coating 76 is made of a laminate of an Ni-electroless plated layer 77 affixed to the joint layer 74 and an Ni-electroplated layer 78 affixed to the cover coating 75.

The others are identical with those in the first embodiment.

The ceramic heater 1 is fabricated in the following manner.

A slurry is prepared in the same manner as described in the first embodiment. The slurry is made into a 1.2 mm thick sheet using a doctor blade technique and stamped out by a stamp press to make a green sheet. The green sheet is drilled to make two pinholes.

Next, a heater pattern is printed with a conductive paste by a screen printing technique on the green sheet in the same manner as in the first embodiment. A conductive paste is filled in the pinholes. Subsequently, on the back surface of the green sheet, terminals which will be the external terminals 72 are printed with a conductive paste containing W and Ni.

Subsequently, an organic binder is prepared and applied to the surface of the green sheet in the same manner as in the first embodiment. The green sheet is wrapped about the periphery of a core bar and then fired in a furnace to make a ceramic bar.

The connector terminals 74 made of Ni-lead wires, as shown in FIGS. 9 and 10, are prepared. To side surfaces of each of the connector terminals 74, a Kovar pad is joined by resistance welding which will be the joint layer 73.

Each of the connector terminals to which the Kovar pads are welded is joined to one of the external terminals 72 using an Au—Cu brazing material at as high as 1000° C. to 1200° C. After such baking, the brazing material becomes the join layer 73 together with the Kovar pad which establishes a firm joint between the external terminal 72 and the connector terminal 74.

Subsequently, as shown in FIG. 11, the surface of each of the connectors 70 made up of the connector terminal 74 and the joint layer 73 is coated with Ni using an electroless plating technique to form the Ni-electroless plated layer 77 having a thickness of 4 μm or more. Further, the surface of the Ni-electroless plated layer 77 is coated with Ni with an electroplating technique to form the Ni-electroplated layer 78 having a thickness of 2 μm or more, thereby making the Ni-plated coating 76.

Finally, the surface of the Ni-plated coating 76 is electroplated with Au to form the cover coating 75 having a thickness of 2.5 μm, thereby completing the ceramic heater 7.

We performed a corrosion resistance test on a sample of the ceramic heater 7 in the same manner as described in the first embodiment and confirmed that the ceramic heater 7 is, like the one of the first embodiment, excellent in the corrosion resistance.

Figure 12:
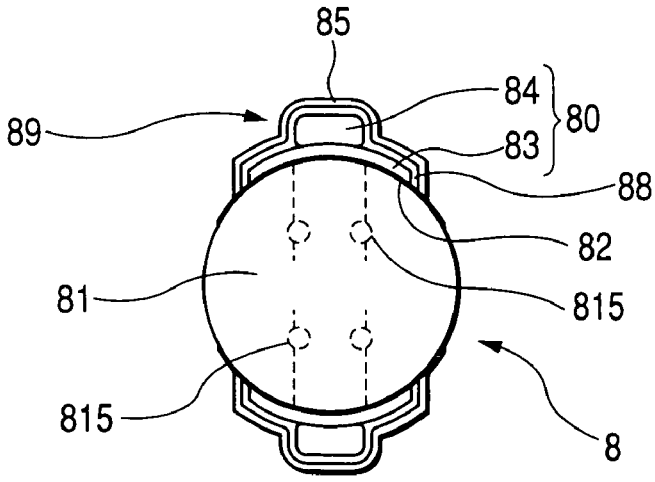
FIG. 12 is a partially traverse sectional view, as taken along the line D—D in FIG. 11, which shows the ceramic heater of FIG. 11.

FIGS. 11 and 12 shows a ceramic heater 8 according to the fourth embodiment of the invention which is made of silicon nitride.

The ceramic heater 8 includes a ceramic body 81 which has heating elements 85 installed therein. The ceramic heater 8 also includes connector assemblies 89. Each of the connector assemblies 89 consists of an external terminal 82 and an electrical connector 80. The external terminals 82 are affixed to an outer surface of the ceramic body 71 in electrical connection with the heating elements 815 in the ceramic body 87, respectively. Each of the connectors 80 consists of a connector terminal 84 and a joint layer 83 which is made of metal and makes an electrical connection between the connector terminal 84 and the external terminal 82. An entire outer surface of each of the connector assemblies 89 is wrapped in the cover coating 85 made of Au.

The ceramic body 81 is made of silicon nitride. The external terminals 82 are made of W (tungsten) and Ni (nickel). Each of the joint layers 83 is made of a Kovar pad and establishes an electrical connection with the connector terminal 84 made of a lead wire. The connector terminals 84 are to be connected to an external power supply to supply electrical power to the heating elements 815 in the ceramic body 81. The connector terminals 84 are made of a Ni-bar having a diameter of 0.6 mm.

Each of the connector assemblies 89 is, as described above, wrapped in the cover coating 85 made of Au.

Between each of the cover coatings 85 and a corresponding one of the connector assemblies 89, an Ni-electroplated coating 88, as clearly illustrated in FIG. 12, is formed.

The others are identical with those in the first embodiment.

The ceramic heater 8 is fabricated in the following manner.

Figure 13:
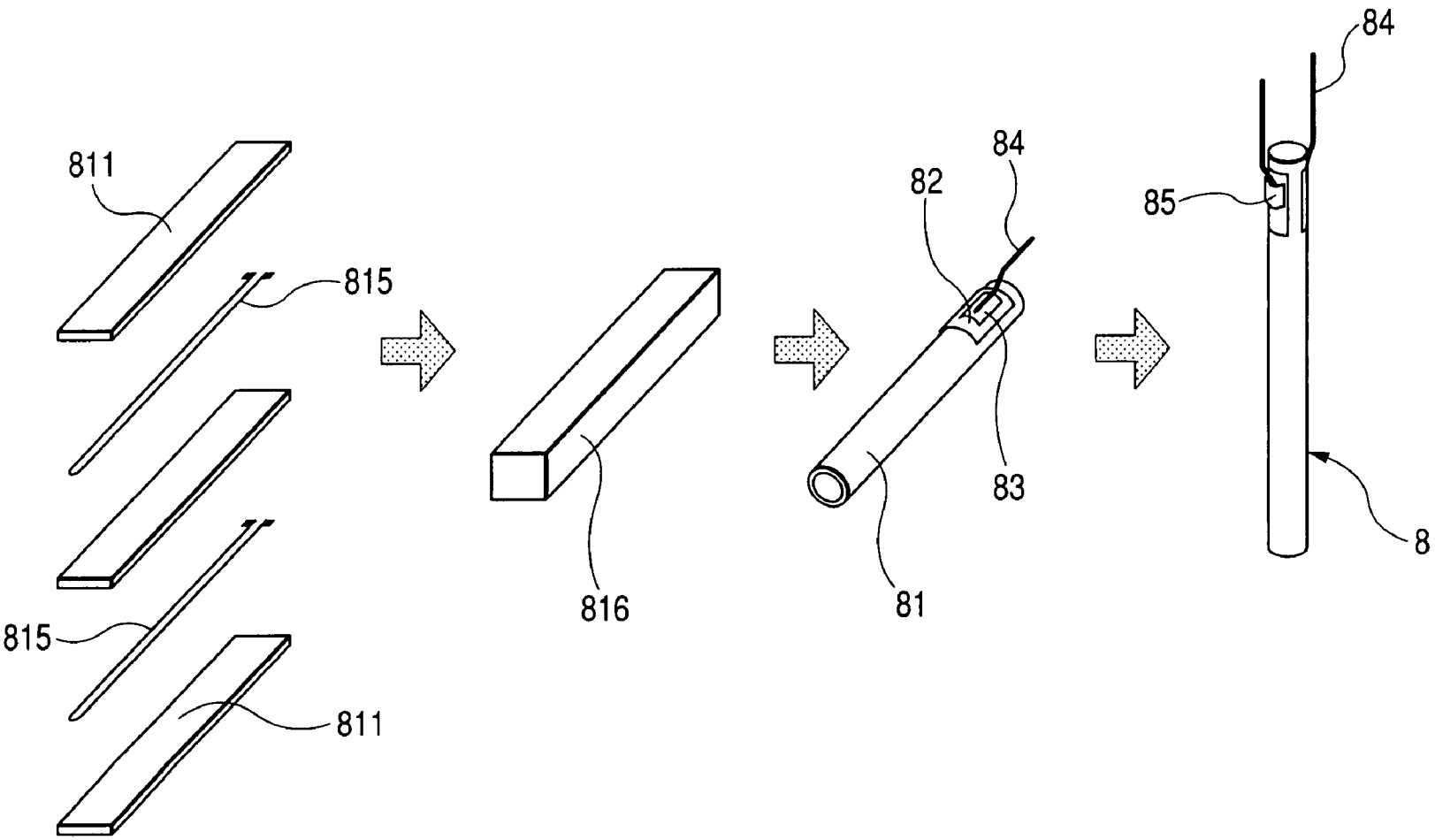
FIG. 13 is a perspective view which shows a sequence of production processes of the ceramic heater of FIGS. 11 and 12.
Figure 14:
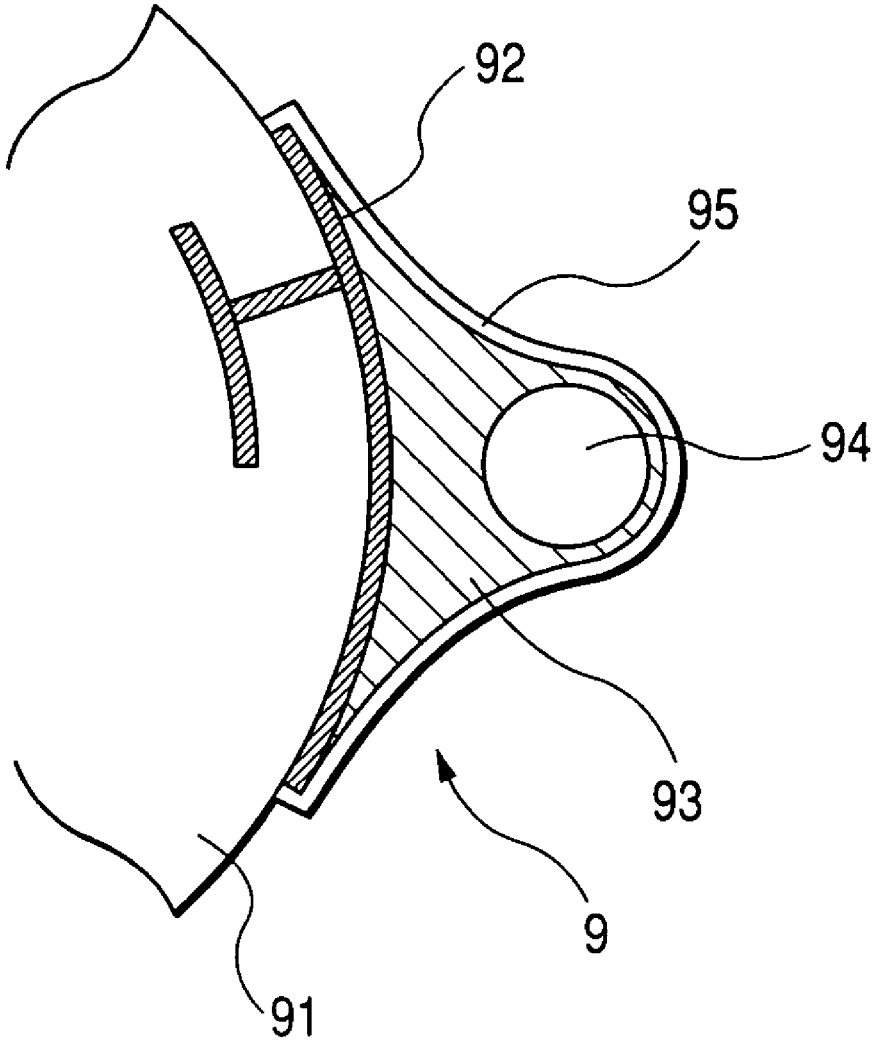
FIG. 14 Prior Art
FIG. 14 is a partially traverse sectional view which shows a conventional ceramic heater.

First, powders containing approximately 60 wt % of Si and approximately 40 wt % of Ni are prepared. The powders are dispersed in a solvent to make slurry. The slurry is made into a 1.2 mm thick sheet using a doctor blade technique and stamped out by a stamp press to make green sheets 811, as illustrated in FIG. 13.

Heating element 815 made of W and Re are prepared and sandwiched between two of the green sheets 811 to make a laminate 816. Terminals containing W and Ni, which will be the external terminals 82, are formed on the surface of the laminate 816 so that each of the terminals is electrically connected to one end of each of the heating elements 815, as clearly shown in FIG. 12. The laminate 816 is fired and then ground or chamfered to produce the cylindrical ceramic body 81 made of silicon nitride.

Subsequently, the connector terminals 84 made of Ni-lead wires are prepared. To a side surface of each of the connector terminals 84, a Kovar pad is joined by resistance welding which will be the joint layer 83.

Each of the connector terminals 84 to which the Kovar pads are welded is joined to one of the external terminals 82 using an Au—Ni brazing material at as high as 1000° C. to 1200° C. After such baking, the brazing material becomes the join layer 83 together with the Kovar pad which establishes a firm joint between the external terminal 82 and the connector terminal 84.

Subsequently, the surface of each of the connector assemblies 89 is plated with Ni using an electroplating technique to form the Ni-electroplated layer 88 having a thickness of 2 μm or more. Further, the surface of Ni-electroplated layer 88 is coated with Au with the electroplating technique to form the cover coating 85 having a thickness of 2.5 μm, thereby completing the ceramic heater 8.

We performed a corrosion resistance test on a sample of the ceramic heater 8 in the same manner as described in the first embodiment and confirmed that the ceramic heater 8 is, like the one of the first embodiment, excellent in the corrosion resistance.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A ceramic heater comprising:

a ceramic body;

a heating element disposed inside said ceramic body;

a connector assembly including an external terminal, a connector terminal, and a metallic joint layer, the external terminal being affixed to an outer surface of said ceramic body in electrical connection with said heating element, the connector terminal being connectable with an external power supply, the joint layer being formed on the external terminal to establish an electrical joint between the external terminal and the connector terminal;

a Ni-plated coating disposed over a surface of said connector assembly; and a cover coating disposed over a surface of said Ni-plated coating, said cover coating made of a metallic material containing a main component of one of Au, Pt, and Cr.

2. A ceramic heater as set forth in claim 1, wherein the main component of the metallic material contains one of Au and Pt, and wherein said cover coating has a thickness of 2.5 μm to 10 μm.

3. A ceramic heater as set forth in claim 1, wherein the main component of the metallic material contains Cr, and wherein said cover coating has a thickness of 0.1 μm to 15 μm.

4. A ceramic heater as set forth in claim 1, wherein said Ni-plated layer has a thickness of 2.0 μm to 24 μm.

5. A gas sensor comprising:

a sensor element including a solid electrolyte body, an air chamber formed inside the solid electrolyte body, an outer electrode affixed to an outer surface of said solid electrolyte body exposed to a gas to be measured, and an inner electrode affixed to an inner surface of said solid electrolyte body exposed to the air chamber; and a ceramic heater disposed within the air chamber, said ceramic heater including (a) a ceramic body; (b) a heating element disposed inside said ceramic body; (c) a connector assembly including an external terminal, a connector terminal, and a metallic joint layer, the external terminal being affixed to an outer surface of said ceramic body in electrical connection with said heating element, the connector terminal being connectable with an external power supply, the joint layer being formed on the external terminal to establish an electrical joint between the external terminal and the connector terminal; (d) a Ni-plated coating disposed over a surface of said connector assembly; and (e) a cover coating disposed over a surface of said Ni-plated coating, said cover coating made of a metallic material containing a main component of one of Au, Pt, and Cr.

6. A ceramic heater as set forth in claim 1, wherein said Ni-plated coating is made of a laminate of an Ni-electroless plated layer affixed to the connector assembly and an Ni-electroplated layer affixed to the cover coating.

7. A gas sensor set forth in claim 5, wherein the main component of the metallic material contains one of Au and Pt, and wherein said cover coating has a thickness of 2.5 μm to 10 μm.

8. A gas sensor as set forth in claim 5, wherein the main component of the metallic material contains Cr, and wherein said cover coating has a thickness of 0.1 μm to 15 μm.

9. A gas sensor as set forth in claim 5, wherein said Ni-plated layer has a thickness of 2.0 μm to 24 μm.

10. A gas sensor according to claim 5, wherein said Ni-plated coating is made of a laminate of an Ni-electroless plated layer affixed to the connector assembly and an Ni-electroplated layer affixed to the cover coating.

* * * * *